US007821482B2

(12) United States Patent
Battersby et al.

(10) Patent No.: US 7,821,482 B2
(45) Date of Patent: Oct. 26, 2010

(54) ACTIVE MATRIX DISPLAY

(75) Inventors: Stephen J. Battersby, Haywards Heath (GB); Martin J. Edwards, Crawley (GB); John R. A. Ayres, Reigate (GB); Alan G. Knapp, Crawley (GB)

(73) Assignee: Chimei Innolux Corporation, Miao-Li County (TW)

( * ) Notice: Subject to any disclaimer, the term of this patent is extended or adjusted under 35 U.S.C. 154(b) by 1115 days.

(21) Appl. No.: 10/528,285

(22) PCT Filed: Sep. 5, 2003

(86) PCT No.: PCT/IB03/03903

§ 371 (c)(1),
(2), (4) Date: Mar. 16, 2005

(87) PCT Pub. No.: WO2004/027747

PCT Pub. Date: Apr. 1, 2004

(65) Prior Publication Data

US 2006/0164363 A1 Jul. 27, 2006

(30) Foreign Application Priority Data

Sep. 19, 2002 (GB) ..... 0221745.3

(51) Int. Cl.
*G09G 3/36* (2006.01)

(52) U.S. Cl. ..... 345/98; 345/149

(58) Field of Classification Search ..... 345/89, 345/98, 695, 149, 204, 211, 694, 100, 103, 345/144

See application file for complete search history.

(56) References Cited

U.S. PATENT DOCUMENTS

| | | | | |
|---|---|---|---|---|
| 5,739,802 | A * | 4/1998 | Mosier | 345/89 |
| 5,751,272 | A * | 5/1998 | Silverbrook et al. | 345/694 |
| 5,805,136 | A * | 9/1998 | Silverbrook et al. | 345/695 |
| 5,923,311 | A | 7/1999 | Edwards | |
| 6,597,349 | B1 * | 7/2003 | Koyama et al. | 345/204 |
| 7,173,612 | B2 * | 2/2007 | Nanno et al. | 345/211 |
| 2003/0146896 | A1 * | 8/2003 | Sekine | 345/98 |
| 2004/0032387 | A1 * | 2/2004 | Lin et al. | 345/98 |

FOREIGN PATENT DOCUMENTS

| | | |
|---|---|---|
| EP | 0 597 536 | 5/1994 |
| JP | 6-214214 | 8/1994 |
| JP | 2000-338918 | 12/2000 |

OTHER PUBLICATIONS

Patent Abstracts of Japan vol. 2000, No. 15, Apr. 6, 2000.

* cited by examiner

*Primary Examiner*—Amare Mengistu
*Assistant Examiner*—Yuk Chow
(74) *Attorney, Agent, or Firm*—Fish & Richardson P.C.

(57) ABSTRACT

An active matrix display has a column driver for providing signals to the pixels for driving the display elements, the column driver comprising digital to analogue converter circuitry providing a first number of display element drive levels. Within each pixel, the first number of display element drive levels is converted into a second, greater number, of pixel grey levels. This combines multi-level digital to analogue conversion with in-pixel level generation and enables the complexity of the DACs to be reduced so that they can be integrated onto the display substrate, for example using low temperature polysilicon processing.

38 Claims, 4 Drawing Sheets

ACTIVE MATRIX DISPLAY

The invention relates to an active matrix display, and in particular to an active matrix display in which the pixels are driven to multiple grey levels, using digital to analogue converter circuits.

Active matrix liquid crystal displays (AMLCDs) are one well known example of active matrix display. In such displays, an active plate and a passive plate sandwich a liquid crystal. The active plate includes a number of electrodes for applying electric fields to the liquid crystal and the electrodes are generally arranged in an array. Row and column electrodes extending along the rows and columns of pixel electrodes connect and drive thin film transistors which drive respective pixel electrodes.

The row and column electrodes are driven to control the thin film transistors to control the charge stored on corresponding pixel electrodes. Each pixel may also include a capacitor for maintaining charge on the pixel.

One difficulty is in providing the necessary circuits for decoding incoming signals and driving the row and column electrodes. Generally, such driver circuits are arranged around the outside the pixel array.

There is currently much interest in the use of low temperature polysilicon (LTPS) to integrate some of the functions of a driver IC onto the glass of an AMLCD. Integration helps save some of the IC cost and can also make the display more compact. One of the functions which it is desirable to integrate is the digital to analogue converters (DACs) used to convert digital input data into the analogue voltage required to fix the transmission of an LC pixel. The complexity of DACs on glass increases significantly as the number bits/pixel is increased. This is because DACs with high conversion accuracies (at least those which can be implemented in LTPS) take up a large area on the glass, and they may not then be cost competitive with the equivalent DAC on a silicon substrate. This is a problem because video and still images require 6 bits/pixel if unpleasant visual artefacts, especially visible in images where colours change very gradually, are to be avoided.

Various driving schemes are also known which drive each pixel with one bit data. This can avoid the need for complicated driver circuits, but of course at the expense of poor image quality. Various techniques are also known which enable a one bit drive scheme to produce a grey level output from the pixel, albeit with a small number of grey levels. One of these techniques is "area weighted grey scaling". In this approach, a pixel is divided into smaller sub-pixel areas, and these may have different areas. For example, two sub-pixels with areas in the ratio 1:2 can be driven with one bit data to provide four different light intensity outputs.

According to the invention there is provided an active matrix display, comprising:

an array of pixels provided over a common substrate, each pixel comprising a display element and a switching device; and a column driver for providing signals to the pixels for driving the display elements, the column driver comprising digital to analogue converter circuitry and providing a first number of display element drive levels greater than 2, wherein each pixel comprises means for converting the first number of display element drive levels into a second, greater number, of pixel grey levels.

This arrangement combines multi-level digital to analogue conversion with in-pixel level generation. This enables the complexity of the DACs to be reduced so that they can be integrated onto the display substrate, for example using low temperature polysilicon processing.

The means for converting may comprise, within each pixel, at least first and second display elements (i.e. sub-pixels) having different areas. In this way, weighted grey scale driving is used within the pixels.

The first and second display elements can then have areas in the ratio 1:2. In this case, for any two drive levels, it is possible to generate two additional intermediate grey scale levels. Thus, if the two drive levels are two adjacent levels of the DAC, then two additional intermediate levels can be generated.

In another embodiment, the means for converting may comprise, within each pixel, charge redistribution circuit elements. This provides an alternative in-pixel level generation. For example, two display elements (sub-pixels) may be used, with an input switch between the input to the pixel and a first display element and a charge redistribution switch between the first and second display elements.

With 2 bit in-pixel level generation, as in the two examples above, for providing 6 bit output (64 levels), 5 bit digital to analogue circuitry can be used. In fact less than all 32 outputs of the 5 bit DAC are required, simplifying the circuitry further.

For example, 22 possible levels are required to implement a 6 bit drive scheme in the area weighting version. In order to convert from the 6 bit drive signal, a converter can then be provided for deriving a signal for selecting which one (or pair) of the first number of levels to apply to each display element.

This converter preferably comprises a divider for dividing by 3 and providing a divisor and a remainder. Thus, a 64 bit signal can be divided by 3 to provide a divisor between 0 and 21 and a remainder will be 0,1 or 2.

In the area weighting case, the divisor can thus determine which of the first number of levels is applied to one or both of the display elements, and the remainder determines which one or ones of the display elements this determined level is applied to.

An adjacent level, for example the next higher level, is then applied to the display elements (if any) to which the determined level is not applied. Thus level n is applied to both display elements for a first brightness, levels n and n+1 are applied for a second brightness and levels n+1 and n are applied for a third brightness.

Each pixel may further comprise a memory element for storing digital drive values for the display elements of each pixel. For example, the weighted grey scale technique can also be used for a standby mode of operation.

The invention also provides a method of driving an active matrix display, comprising:

providing first and second drive voltages to a display pixel having first and second display elements, the first and second drive voltages being selected from two adjacent drive voltage levels of a digital to analogue converter which has more than 2 analogue output levels; and within the pixel, generating an intermediate grey level corresponding to a drive voltage between the first and second levels.

This method combines an analogue drive scheme with in-pixel level generation. The first display element may have a first area and the second display element may have a second area different to the first area, area weighting being then being used to generate the intermediate grey level.

Alternatively, charge sharing between the display elements can be used to generate the intermediate grey level.

The analogue drive voltages are provided from a column driver circuit which may be integrated onto the active plate of the active matrix display, and the complexity of the DAC is reduced by the in-pixel conversion.

In one example, a 5 bit input for the DAC is derived from a 6 bit data signal by dividing the 6 bit data signal by 3 and providing a divisor and a remainder. The divisor then determines the first drive voltage, and the remainder determines how the sub-pixels are controlled.

For a better understanding of the invention, embodiments will now be described, purely by way of example, with reference to the accompanying drawings in which.

It should be noted that none of the Figures are to scale. Like or corresponding components are generally given the same reference numeral in different Figures.

Figure 1:
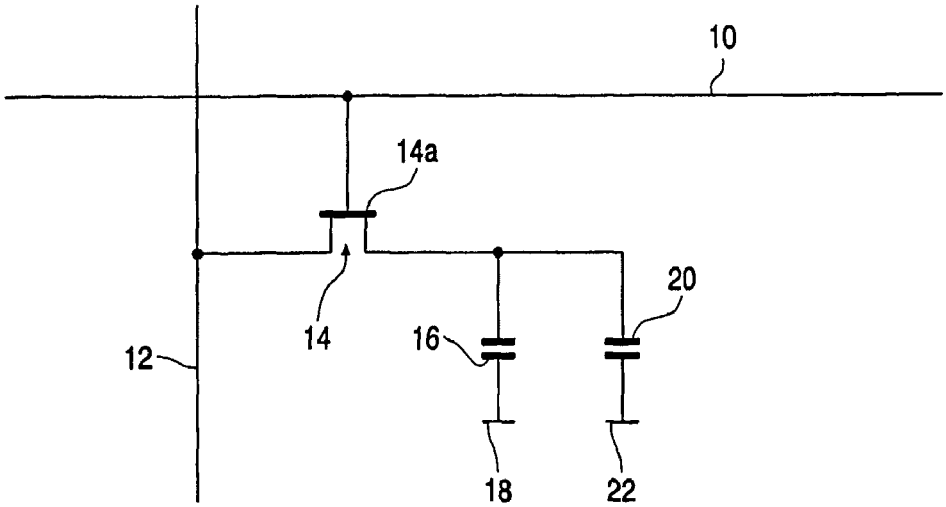
FIG.1 (PRIOR ART)
FIG. 1 shows a known liquid crystal pixel circuit.

FIG. 1 shows a conventional pixel configuration for an active matrix liquid crystal display. The display is arranged as an array of pixels in rows and columns. Each row of pixels shares a common row conductor 10, and each column of pixels shares a common column conductor 12. Each pixel comprises a thin film transistor 14 and a liquid crystal cell 16 arranged in series between the column conductor 12 and a common electrode 18. The transistor 14 is switched on and off by a signal provided on the row conductor 10. The row conductor 10 is thus connected to the gate 14*a* of each transistor 14 of the associated row of pixels. Each pixel additionally comprises a storage capacitor 20 which is connected at one end 22 to the next row electrode, to the preceding row electrode, or to a separate capacitor electrode. This capacitor 20 stores a drive voltage so that a signal is maintained across the liquid crystal cell 16 even after the transistor 14 has been turned off.

In order to drive the liquid crystal cell 16 to a desired voltage to obtain a required grey level, an appropriate analogue signal is provided on the column conductor 12 in synchronism with a row address pulse on the row conductor 10. This row address pulse turns on the thin film transistor 14, thereby allowing the column conductor 12 to charge the liquid crystal cell 16 to the desired voltage, and also to charge the storage capacitor 20 to the same voltage. At the end of the row address pulse, the transistor 14 is turned off, and the storage capacitor 20 maintains a voltage across the cell 16 when other rows are being addressed. The storage capacitor 20 reduces the effect of liquid crystal leakage and reduces the percentage variation in the pixel capacitance caused by the voltage dependency of the liquid crystal cell capacitance.

The rows are addressed sequentially so that all rows are addressed in one frame period, and refreshed in subsequent frame periods.

Figure 2:
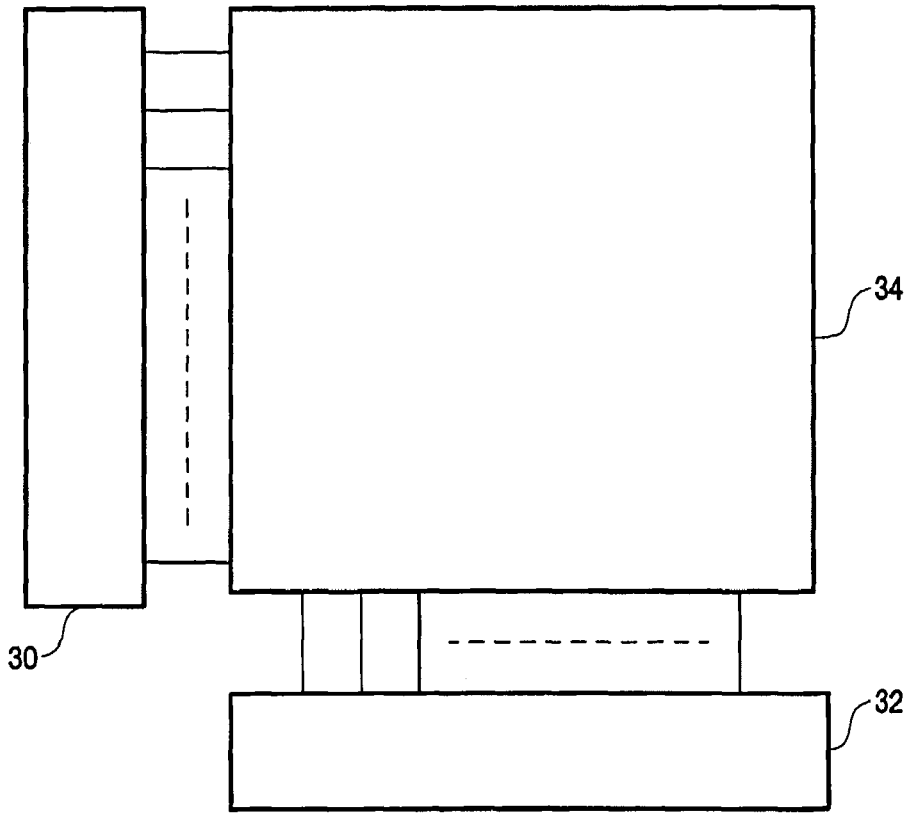
FIG.2 (PRIOR ART)
FIG. 2 shows the general components of a liquid crystal display.

As shown in FIG. 2, the row address signals are provided by row driver circuitry 30, and the pixel drive signals are provided by column address circuitry 32, to the array 34 of display pixels. The column address circuitry includes digital to analogue converters (DACs) for converting a digital control signal, for example a 6 bit control signal, into an appropriate analogue level for driving a column conductor 12 associated with the DAC.

It is difficult to integrate large DACs, for example 6 bit DACs, onto the substrate of the pixel array, but this integration is desirable for a number of reasons. The invention is therefore concerned with simplifying the DAC circuitry whilst maintaining the grey scale resolution.

Figure 3:
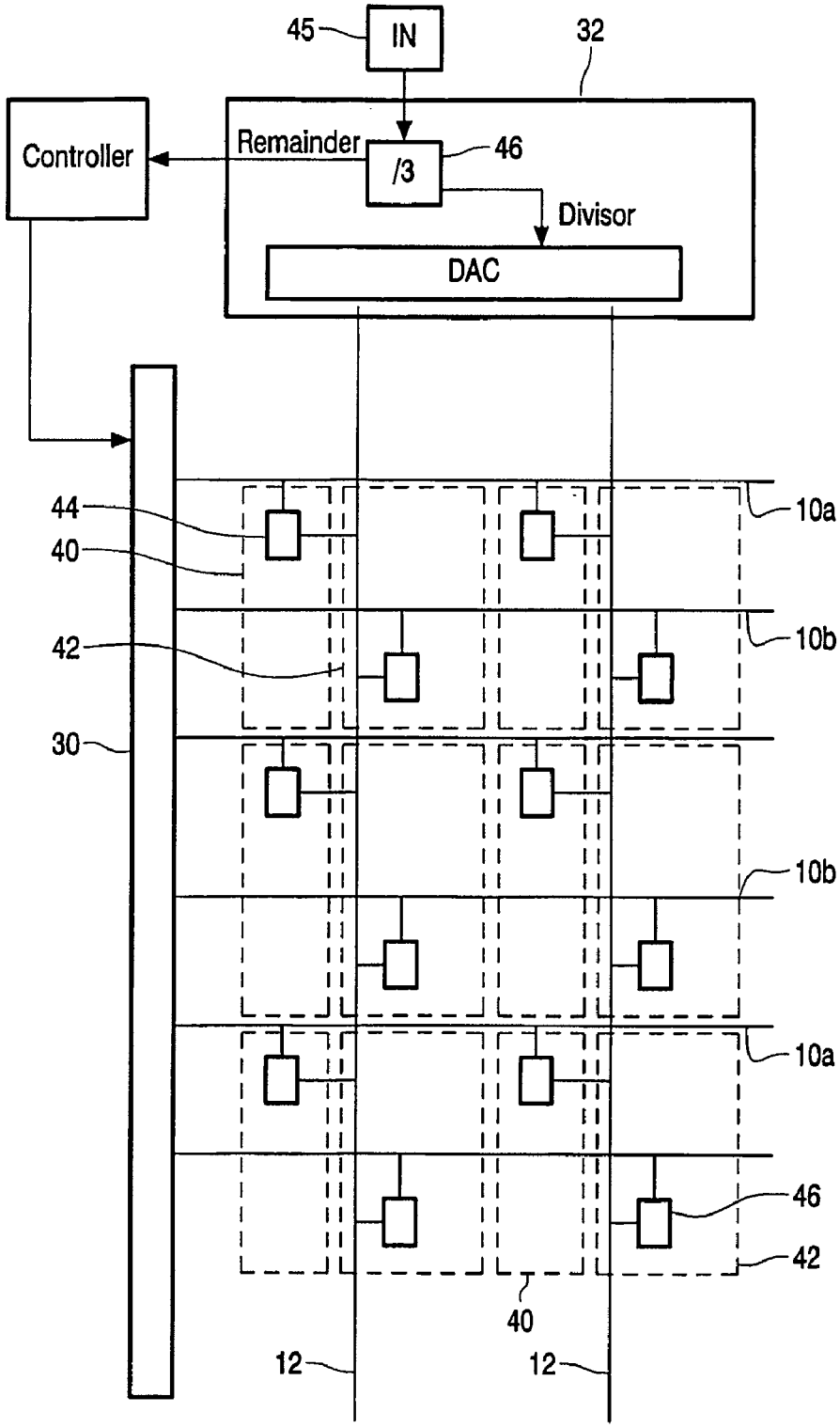
FIG. 3 shows a first example of liquid crystal display of the invention.

A first example of display according to the invention is shown in FIG. 3, in which the same reference numerals are used as in FIGS. 1 and 2 for the same components.

Each pixel comprises (at least) first and second display elements 40,42, namely sub-pixels, having areas in the ratio 1:2 as schematically shown in FIG. 3. This enables weighted grey scale driving to be carried out. Each sub-pixel 40,42 is addressed using a sub-row conductor 10*a*,10*b* so that there are twice as many sub-row conductors as rows of pixels. In a preferred example, data of less than 6 bit D/A conversion accuracy is fed onto the sub-pixels, and extra accuracy is created by driving the sub-pixels to different grey levels.

Sub-pixels 40 have associated pixel circuits 44 and sub pixels 42 have associated pixel circuits 46. These pixel circuits may be as in FIG. 1, although it will be understood that there are many different specific known pixel circuit designs. Each sub-pixel also is driven by a shared column conductor 12. The number of outputs from the column driver 32, and therefore the number of DACs, is thus still equal to the number of columns of full pixels.

Alternatively, separate columns may be provided for each sub-pixel, but the sub-pixels may share a common row electrode. Although this would increase the complexity of the column drive circuit, it may not be a significant increase since the voltages applied to the pairs of sub-pixels are closely related, being adjacent grey scale voltages.

The sub-pixels are driven either to the same grey level or the next grey level, as follows:

| Sub-pixel 42 | Sub-pixel 44 | Effective Pixel Output |
|---|---|---|
| n | n | n |
| n + 1 | n | n + 1/3 |
| n | n + 1 | n + 2/3 |

This arrangement combines multi-level digital to analogue conversion with area weighting grey scale techniques. This enables the complexity of the DACs to be reduced so that they can be integrated onto the display substrate, for example using low temperature polysilicon processing.

This specific implementation introduces 2 additional grey levels between every pair or grey levels provided by the DACs. In this case, grey levels n and n+1 are provided by the DACs and grey levels n+⅓ and n+⅔ are generated as a result of applying these grey levels to different sub-pixels. Hence, if the DACs provide m grey levels, the area weighted grey scale technique generates 2 new levels for every pair of grey levels provided by the DAC. There are m−1 pairs, so 2(m−1) new levels are generated to be added to the original m grey levels from the DAC, making 3 m−2 grey levels in total. In order to generate a 6 bit image, 64 grey levels are needed in total, implying that m=22. If the grey level voltages from the DAC are equally spaced, all 64 levels will be equally spaced. However, it is more likely that some Gamma correction will be generated by the DACs. In this case, the new grey levels are linear interpolations between each pair of grey levels.

The DACs therefore require 22 voltages to be available for decoding onto the columns. This is greater than the 16 required for a conventional 4 bit DAC, but less than the 32 required for a 5 bit DAC and much less than the 64 required for a 6 bit DAC. The DAC is therefore likely to be much smaller than a conventional 6 bit DAC. One issue, however, is the decoding of the 6 bit data signal to select the correct one out of the 22 voltages available in the DAC and to order these correctly in time to ensure the sub-pixels are set to the correct grey levels. In fact, this can be done quite simply.

The 6 bit data 45 fed to the display has values between 0 and 63. If this is fed into a ÷3 block 46 (either in LTPS or in a separate controller IC), two outputs will be generated: the divisor and the remainder. The divisor will lie between 0 and 21, each representing a unique one of the 22 voltages available in the DAC. The remainder will lie between 0 and 2. A 0 remainder requires that both sub-pixels are set to the same grey level, say level n. A 1 remainder requires that the smaller sub-pixel 42 is set to the adjacent grey level (n+1) whilst the larger pixel 44 is set to level n. A 2 remainder requires this assignation to be reversed, so that the smaller sub-pixel 42 is set to the grey level n whilst the larger pixel 44 is set to level n+1. The remainder is thus used to control the row address circuitry in the example of FIG. 3.

In practice, the controller IC would use the remainder to generate a suitable stream of data, with two sets of data per row (one for each sub-row) in sequence, with the first and second data values set to the correct value to select the correct one of the 22 available voltages. Each data set must be 5 bit, as the decoder must select from one of 22 available voltages, not just 16 as would be the case for a 4 bit DAC.

In summary, therefore, the DAC of this implementation requires decoders to select one of 22 available voltages using a 5 bit data signal running at twice the rate (because of the two sub row conductors 10*a*, 10*b*) of a display without area-weighted grey levels but which is capable of achieving 6 bit images.

As the sub-pixels are always driven to adjacent grey levels, the visual artefacts usually associated with area-weighted grey scale techniques when used with a bi-level electro-optic effect will be invisible. Furthermore, the sub-pixels will be driven to near-identical voltages so the column will already be nearly at the correct voltage when the second sub-pixel is charged. As a result, in spite of the fact that the display has, effectively, twice the normal number of rows, the time required for charging the second sub-pixel can be very short. This will allow a large fraction of the line time for charging the first sub-pixel so that the requirement on the charging time of the DACs will be little changed from that of a display without sub-pixellation. This means that the DAC power consumption will only be slightly increased over a display without sub-pixellation and just 4 bit DACs. A small store can be provided to even out the flow of data from the controller IC.

The display can be driven with each sub-row selected separately. In this case, the shared column conductor is used for one sub-row in one address period and used for the other sub-row for the other address period. Alternatively, both sub-rows can be selected and charged together, then one sub-row deselected, a new voltage at an adjacent grey level made available at the DACs and a further short settling time allowed before moving on to the next row. In this case, the addressing of the second sub-row is only required to change the charge on the sub-pixel by an amount corresponding to at most one grey level (if at all), so that the second row address pulse can be shorter than the combined row address pulse.

An especially attractive feature of this implementation is the uncomplicated way in which the use of this area-weighted grey scale techniques fits together with a way of improving an unrelated, but equally important, factor in the design of displays for mobile electronic products, namely the display power consumption. LTPS can be used to reduce the power consumption of an AMLCD in a mode known as standby mode through the use of a memory element integrated in each pixel.

The example above combines sub-pixel area weighting with low resolution analogue drive to increase the grey scale resolution. There are, however, alternative in-pixel arrangements which can be used to provide additional voltage levels within the pixels.

U.S. Pat. No. 5,448,258 discloses a display in which in-pixel DAC circuitry is used to enable the pixels to be driven with digital signals, by addressing each pixel with a sequence of data inputs representing the bits of the digital drive word. Within each pixel, a charge redistribution technique is used to generate the corresponding analogue drive voltage. Although this technique is used in U.S. Pat. No. 5,448,258 to allow multi-bit digital addressing of the pixels, the same charge redistribution technique can be employed as an alternative method of providing additional drive levels within the pixel, and this document is incorporated herein as reference material.

Figure 4:
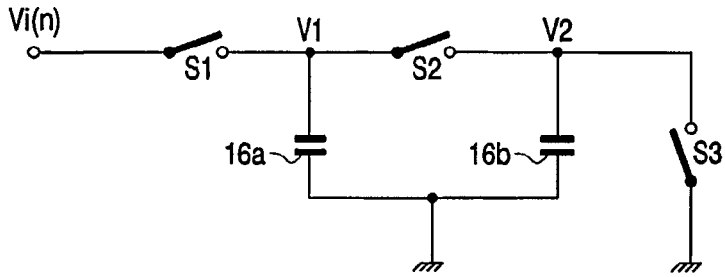
FIG. 4 shows a second example of pixel for a liquid crystal display of the invention.

FIG. 4 shows the pixel arrangement of U.S. Pat. No. 5,448,258. The display element of each pixel is divided into two sub-pixels 16*a*, 16*b*, which act as capacitors for the charge sharing function. Switches S1 and S2 control the application of the column drive voltage to the pixel as well as the charge sharing operation, whereas switch S3 is for a rest operation. The input switch S1 is between the input and the pixel electrode for one sub-pixel 16*a*, and the charge redistribution switch S2 is between the pixel electrodes of the two sub-pixels 16*a*, 16*b*. The two display sub-pixels are thus in parallel with a shared common electrode. The reset switch S3 is provided to enable discharge of the display sub-pixel 16*b*.

To perform a conversion, switch S3 is first closed to discharge sub-pixel 16*b* and to set the voltage at point V2 to zero. There then follow a number of cycles during which the switches S1 and S2 are operated. During each cycle, a voltage at the input, Vi(n), is applied to the input of the circuit.

In the use of the circuit in U.S. Pat. No. 5,448,258, this voltage takes one of two values and represents the state of each bit in turn of the digital data to be converted. In this application, the same circuit can be used to define intermediate grey levels from two adjacent analogue input levels, with a different switching operation, which will now be described.

The lower analogue voltage level is first stored on both sub-pixels 16*a*, 16*b*. A 2 bit digital to analogue conversion is then carried out using the two analogue levels as the voltage levels representing digital "0" and "1".

Two bits of data are presented to the circuit in series, each bit comprising either the analogue value representing "1" or the analogue value representing "0". During each cycle, the switch S1 is first closed allowing the sub-pixel 16*a* to charge to the input voltage level. Switch S1 is then opened and switch S2 closed allowing charge sharing to take place between the two sub-pixels. The voltages V1 and V2 equalise and S2 is then opened once more to complete the cycle. Thus, the same voltage is eventually stored on both sub-pixels, which improves image quality.

The number of cycles determines the resolution, i.e. the number of bits, of the conversion. Thus, there are two cycles for the two bit conversion described above. At the end of the conversion the voltages V1 and V2 have a value which lies between the two adjacent analogue voltage levels (or is equal to the lower analogue level if the digital word is 00). The sequence of digital input bits is effectively scaled by increasing powers of two and the final voltage therefore represents the analogue equivalent of the digital data fed into the circuit.

In this conversion, three additional voltage levels result between each pair of analogue voltage levels, so that 4 m−3 levels result from m analogue levels, using the same logic as above. 17 analogue levels are thus needed, which again requires DAC circuits of complexity between 4 and 5 bits.

Figure 5:
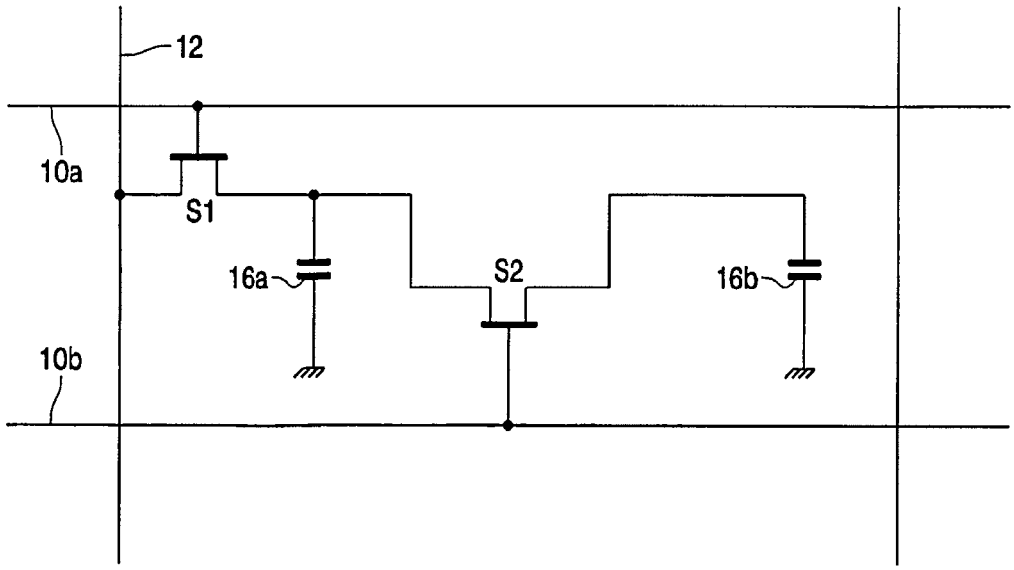
FIG. 5 shows in greater detail the implementation of the pixel circuit of FIG. 4.

FIG. 5 shows an implementation of the pixel of FIG. 4. As shown, the switches S1 and S2 are implemented as TFTs, and the capacitors are defined by the LC cells themselves. It is seen that the picture pixel of FIG. 5 contains all the elements of the converter circuit of FIG. 4 except the discharging switch S3. However the voltage on the sub-pixel 16*b* can still be discharged, or reset, simply by holding the column voltage at an appropriate level and simultaneously turning on both TFT S1 and TFT S2. As shown, there are two row conductors 10*a*, 10*b*, but the second row conductor may be the single row conductor for the next row with appropriate design of the row control voltages.

In this pixel circuit, the sub-pixels may be of equal size, although they may also be different sizes (and therefore capacitances). This design provides an alternative way of converting a first number of analogue display drive levels into a second, greater number, of pixel grey levels.

It has been proposed to integrate memory storage elements into the structure of display devices for this purpose. It has also been recognised that the introduction of memory cells does not necessarily require an increase in the size or complexity of the device substrate. For example, in a liquid crystal display, the pixel electrode (for example 40 and 42 in FIG. 3) occupies a significantly greater area than the drive transistor and storage capacitor (44 and 46 in FIG. 3). If the pixel electrode is able to overlie the electronic components, it is possible to introduce additional components such as memory elements adjacent the drive transistors, without changing the size of the pixel electrodes.

Various different structures have been proposed for the active plate of active matrix liquid crystal displays, in which memory elements are associated with the display pixels. In each case, the purpose of the memory element is to store the pixel data, so that the pixels can be driven from integrated memory elements as well as from applied signal data.

A major benefit of this possibility is that a reduction in power consumption can be achieved. In particular, one problem with conventional displays arises from the need to invert the liquid crystal driving voltages, typically each frame. As a consequence of the 60 Hz frame rate, alternating the polarity gives rise to a 30 Hz signal, which produces flicker. To reduce this flicker, it is known to invert the polarity of the pixel drive signals for adjacent rows of pixels. However, this results in a high power consumption drive scheme.

A memory element associated with each pixel can be used to enable a reduction in power consumption, by avoiding the need to rewrite data to each pixel when the pixel data is unchanged. In addition, the pixels can be driven in two modes—one in which signal data is applied to the pixel, and one in which memory data is applied to the pixel.

In the standby mode, a fixed image at low colour depth (e.g. just 1-2 bits/pixel) can be used to convey a simple status message to the user. Using LTPS to create an in-pixel memory of 1-2 bits allows the driver IC and interface to be powered down in this standby mode, thereby saving power. The in-pixel memory fixes selected sub-pixels black or white depending on the desired grey level and the eye is relied upon to integrate the combined effect of these sub-pixels into an average grey level. Unfortunately, the eye can usually resolve this sub-pixellation, as the difference in grey level between the sub-pixels is large, being either black or white. As a result, quite unpleasant visual artefacts can be seen, again most visible in images with gradually changing colours.

In the area weighting arrangement described above, the similarity of grey level to which the two sub-pixels are set in the normal drive mode Oust one grey level apart) will ensure that the visual artefacts noted above for the area-weighted grey scale technique do not apply. In addition, the additional power consumption in the DACs is not as great as might be implied by the need to drive a display with twice as many rows.

Figure 6:
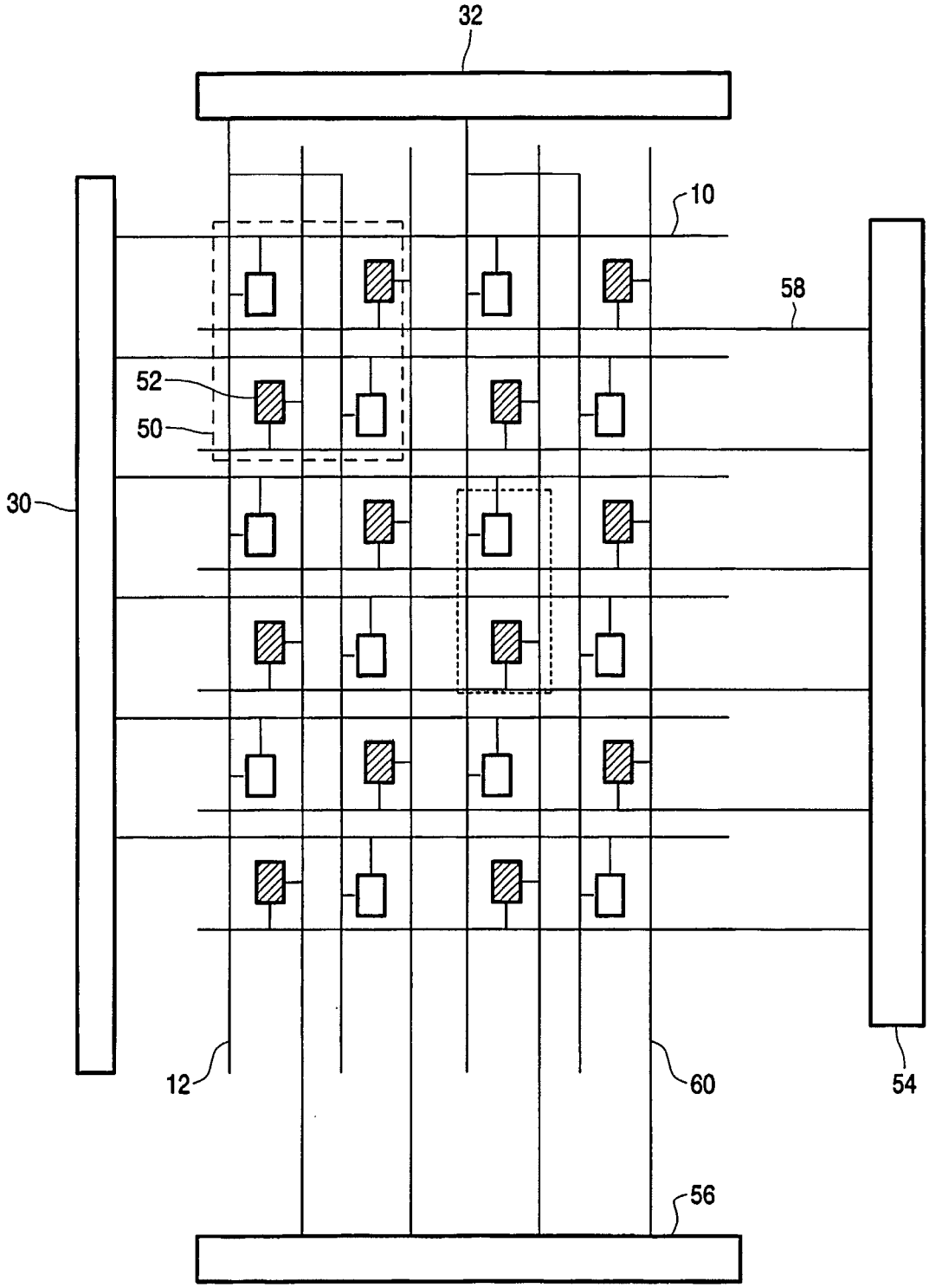
FIG. 6 shows a third example of liquid crystal display of the invention.

FIG. 6 shows a modification to FIG. 3 to include memory capability. Within the area 50 of each pixel (which is the combined area of the two sub-pixels 40,42), there are provided two memory cells 52 (shown hatched in FIG. 4). Memory address circuitry 54, 56 is provided to enable data to be written to each memory cell, and to enable data to be read from each memory cell. This can be carried out independently of the signal data associated with each pixel, or else the memory cells may be able only to output their data to the sub-pixels. Each memory cell 52 is associated with a unique pair of row and column memory address lines 58, 60.

In the example of FIG. 6, the memory cells 52 are associated with separate memory address circuitry 54, 56. Furthermore, separate row and column address lines 58, 60 are provided for the memory cells 52. However, it is equally possible for the pixel row or column address lines 10, 12 to be shared between the pixel circuit and the memory cells 22. This will depend on the functionality to be implemented. This will be apparent to those skilled in the art.

This arrangement provides a way of making a display with 2 bits/pixel standby images and 6 bit/pixel video images using a DAC of complexity intermediate between and 4 and a 5 bit DAC. The technique could be used to add extra colour depth to an amorphous silicon display, as well as enabling of DACs for a LTPS display.

The integration of memory elements into a pixel design using charge redistribution instead of area weighting is also possible, but will not be described in detail in this application.

In the example above, two different possible ways of increasing the number of analogue levels within each pixel have been disclosed. Other in-pixel level generation techniques may also be possible, as will be apparent to those skilled in the art.

In the examples above, the display is a liquid crystal display. It should be understood that the invention can be applied to other types of display, such as electroluminescent displays. Also, the specific examples combine a two bit pixel with a DAC of 4-5 bit complexity to achieve 6 bit resolution. Other examples are of course possible, and the invention more generally takes advantage of in pixel level generation, for example based on sub-pixellation or charge redistribution, to enable a reduction in DAC complexity to achieve a given resolution.

Other examples will be apparent to those skilled in the art.

The invention claimed is:

1. An active matrix display, comprising:

an array of pixels provided over a common substrate, each pixel comprising a display element and a switching device;

a column driver for providing signals to the pixels for driving the display elements, the column driver comprising digital to analogue converter circuitry providing at most $2^P$ display element drive levels from a p bit digital data signal, wherein p is a positive integer; and a converter for deriving from a 6 bit drive signal a signal for selecting which one or ones of the display element drive levels to apply to each display element;

wherein each pixel comprises means for receiving the display element drive levels and converting the display element drive levels into a number of pixel grey levels greater than $2^p$, and the converter comprises a divider for dividing the 6 bit drive signal by 3 and providing a divisor and a remainder.

2. A display as claimed in claim 1, wherein the means for converting comprises, within each pixel, at least first and second display elements having different areas.

3. A display as claimed in claim 2, wherein the first and second display elements have areas in the ratio 1:2.

4. A display as claimed in claim 1, wherein the means for converting comprises, within each pixel, charge redistribution circuit elements.

5. A display as claimed in claim 4, wherein the charge redistribution elements comprise two display elements, an input switch between the input to the pixel and a first display element and a charge redistribution switch between the first and second display elements.

6. A display as claimed in claim 1, wherein the divisor determines which of the first number of levels is applied to one or both of the display elements, and the remainder determines which one or ones of the display elements this determined level is applied to.

7. A display as claimed in claim 6, wherein an adjacent level is applied to the display elements (if any) to which the determined level is not applied.

8. A display as claimed in claim 1, comprising a plurality of row conductors, a number of row conductors being associated with each row of pixels corresponding to the number of display elements within each pixel.

9. A display as claimed in claim 1, wherein each pixel comprises a memory element for storing digital drive values for the display elements of each pixel.

10. A display as claimed in claim 1, wherein the digital to analogue circuitry is provided on the common substrate.

11. A display as claimed in claim 10, wherein the pixel array and the digital to analogue circuitry are formed using low temperature polysilicon processing.

12. A method of driving an active matrix display, comprising:

providing first and second drive voltages to a display pixel having first and second display elements, the first and second drive voltages being selected from two adjacent drive voltage levels of a digital to analogue converter that provides at most $2^P$ display element drive levels from a p bit digital data signal, wherein p is a positive integer; and within the pixel, generating an intermediate grey level corresponding to a drive voltage between the first and second levels, wherein each of the first and second display elements is configured to receive one of the first and second drive voltages, and the first and second drive voltages are provided by a digital to analogue converter which receives a 5 bit input derived from a 6 bit data signal by dividing the 6 bit data signal by 3 and providing a divisor and a remainder.

13. A method as claimed in claim 12, wherein the divisor determines the first drive voltage, and the remainder determines whether the first and second drive voltages are the same or are different.

14. A method as claimed in claim 12, wherein charge sharing between the display elements is used to generate the intermediate grey level.

15. A method as claimed in claim 14, wherein the first and second drive voltages are provided by a digital to analogue converter which receives a 5 bit input.

16. A method as claimed in claim 12, wherein the drive voltages are provided from a column driver circuit integrated onto the active plate of the active matrix display.

17. A method as claimed in claim 12, wherein each of the first display element and the second display element selectively receives the first drive voltage or the second drive voltage to enable the display pixel to generate four pixel grey levels.

18. A display comprising:

a plurality of pixels, each pixel comprising a display element;

a digital to analog converter to provide a first number of display element drive levels, the first number being greater than 2; and a converter to derive from a q1 bit drive signal a signal to select which one of the first number of levels to apply to each display element, the converter comprising a divider to divide by q2 and provide a divisor and a remainder, q1 and q2 being integers greater than 1;

wherein each pixel converts the first number of display element drive levels into a second, greater number, of pixel grey levels.

19. The display of claim 18 in which q1 is equal to 6.

20. The display of claim 18 in which q2 is equal to 3.

21. The display of claim 18, comprising a column driver for providing signals to the pixels for driving the display elements, the column driver comprising the digital to analog converter.

22. The display of claim 18 in which each pixel comprises at least first and second display elements having different areas.

23. The display of claim 22 in which the divisor determines which of the first number of levels is applied to one or ones of the at least first and second display elements, and the remainder determines which one or ones of the at least first and second display elements this determined level is applied to.

24. The display of claim 18 in which the first and second display elements have areas in the ratio 1:2.

25. A method comprising:

receiving an r1 bit input derived from an r2 bit data signal by dividing the r2 bit data signal by r3 and providing a divisor and a remainder, r1, r2, and r3 being integers greater than 1;

determining first and second drive voltages based on the divisor and the remainder;

selectively providing the first and second drive voltages to a display pixel having first and second display elements; and within the display pixel, generating an intermediate grey level corresponding to a third drive voltage between the first and second drive voltages.

26. The method of claim 25 in which charge sharing between the display elements is used to generate the intermediate grey level.

27. The method of claim 25 in which the first and second drive voltages are selected from two adjacent drive voltage levels of a digital to analog converter that has more than 2 output levels.

28. The method of claim 25 in which r1 equals 5.

29. The method of claim 25 in which r2 equals 6.

30. The method of claim 25 in which r3 equals 3.

31. The method of claim 25 in which the divisor determines the first drive voltage, and the remainder determines whether the first and second drive voltages are the same or are different.

32. The method of claim 25 in which the first display element has a first area and the second display element has a second area that is different from the first display area.

33. The method of claim 32, comprising within the display pixel, generating an intermediate grey level corresponding to a third drive voltage between the first and second drive voltages using area weighting.

34. The method of claim 25 in which the first and second drive voltages are selected from two adjacent drive voltage levels of a digital to analog converter that has more than 2 output levels.

35. The method of claim 25 in which a plurality of sub-rows of pixels are addressed in turn, each sub-row comprising respective display elements for each pixel.

36. The method of claim 25 in which a plurality of rows of pixels are addressed in turn, each row being addressed once to address both display elements and a second time to readdress the second display element.

37. The method of claim 25 in which each of the first display element and the second display element selectively receives the first drive voltage or the second drive voltage to enable the display pixel to generate four pixel grey levels.

38. The method of claim 25 in which the first display element and the second display element both receive the first drive voltage or the second drive voltage.

* * * * *